US010940596B2

(12) United States Patent
Mount

(10) Patent No.: US 10,940,596 B2
(45) Date of Patent: Mar. 9, 2021

(54) HAIR TRIMMING DEVICE

(71) Applicant: BARBARISMO LIMITED, Dorset (GB)

(72) Inventor: Timothy Richard Mount, Dorset (GB)

(73) Assignee: THE IP BUSINESS LTD, Dorset (GB)

( * ) Notice: Subject to any disclaimer, the term of this patent is extended or adjusted under 35 U.S.C. 154(b) by 0 days.

(21) Appl. No.: 16/326,899

(22) PCT Filed: Sep. 1, 2017

(86) PCT No.: PCT/IB2017/055277
§ 371 (c)(1),
(2) Date: Feb. 22, 2019

(87) PCT Pub. No.: WO2018/042383
PCT Pub. Date: Mar. 8, 2018

(65) Prior Publication Data

US 2019/0184587 A1 Jun. 20, 2019

(30) Foreign Application Priority Data

Sep. 1, 2016 (GB) ..... 1614886
Apr. 3, 2017 (GB) ..... 1705368

(51) Int. Cl.
*B26B 19/16* (2006.01)

(52) U.S. Cl.
CPC ..... *B26B 19/16* (2013.01)

(58) Field of Classification Search
CPC ..... B26B 19/16
See application file for complete search history.

(56) References Cited

U.S. PATENT DOCUMENTS 1,543,387 A 6/1925 Kawalle
2,052,495 A * 8/1936 Sonne ..... B26B 19/16 30/41.6
2,146,783 A * 2/1939 Whalen ..... B26B 19/16 30/43.6
2,281,922 A * 5/1942 Dalkowitz ..... B26B 19/16 30/43.6
2,645,847 A * 7/1953 Slonek ..... B26B 19/16 30/43.4
2,785,461 A 3/1957 De Lalla, Sr.
(Continued)

FOREIGN PATENT DOCUMENTS

CN 2401330 Y * 10/2000
DE 2406510 8/1974
(Continued)

OTHER PUBLICATIONS

PCT International Search Report and Written Opinion, PCT/IB2017/055277, dated Jan. 4, 2018.

*Primary Examiner* — Hwei-Siu C Payer
(74) *Attorney, Agent, or Firm* — William H. Bollman

(57) ABSTRACT

A manually operated hair trimming device having a barrel which is rolled over hair to be trimmed. The barrel has at least one aperture through which hair is able to protrude. The device has a first cutting blade provided inside the barrel and a second cutting blade is associated with the barrel. In use, as the barrel is rolled over hair to be trimmed, hair protrudes through the at least one aperture and is cut by a shearing force between relatively moving first and second cutting blades.

14 Claims, 14 Drawing Sheets

(56) References Cited

U.S. PATENT DOCUMENTS

| | | | | | |
|---|---|---|---|---|---|
| 3,037,281 | A | * | 6/1962 | Stone | B26B 19/30<br>30/43.4 |
| 3,245,145 | A | * | 4/1966 | Buford | B26B 19/16<br>30/43.5 |
| 3,494,031 | A | | 2/1970 | Sklenar | |
| 4,884,338 | A | | 12/1989 | Stewart | |
| 4,912,845 | A | * | 4/1990 | Inoue | B26B 19/16<br>30/43.4 |
| 2019/0184587 | A1 | * | 6/2019 | Mount | B26B 19/16 |
| 2019/0240852 | A1 | * | 8/2019 | Davos | B26B 19/14 |

FOREIGN PATENT DOCUMENTS

| | | | | |
|---|---|---|---|---|
| GB | 532450 | | * | 1/1941 |
| GB | 2544155 | A | * | 5/2017 |
| JP | 2826151 | | * | 9/1998 |

* cited by examiner

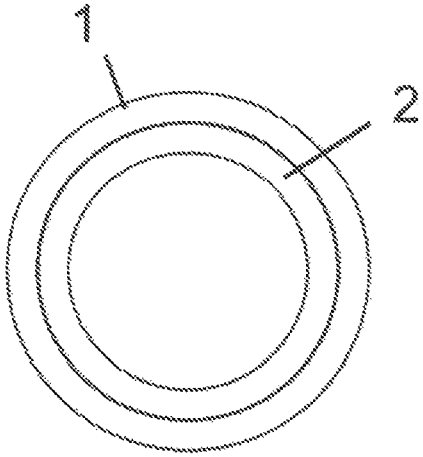
fig. 3a
fig. 3b
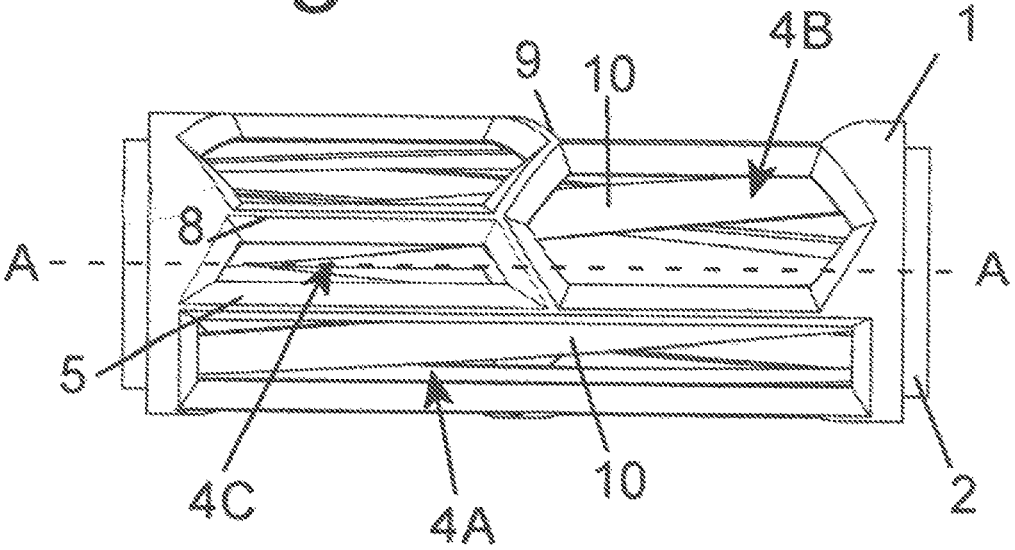

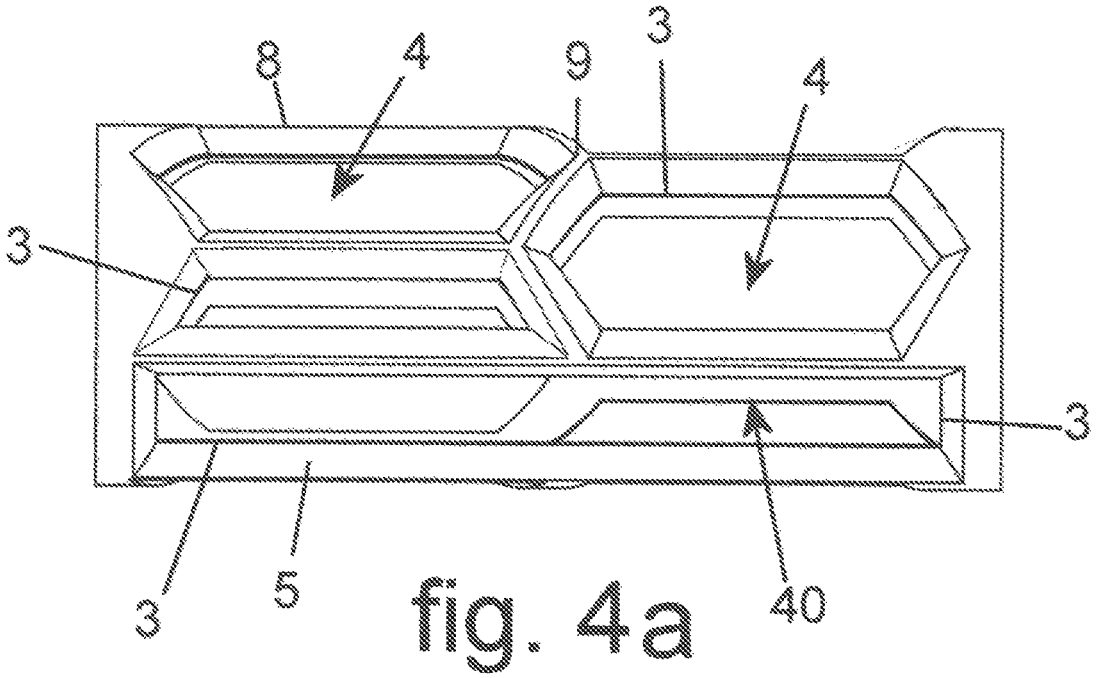
fig. 4a
fig. 4b
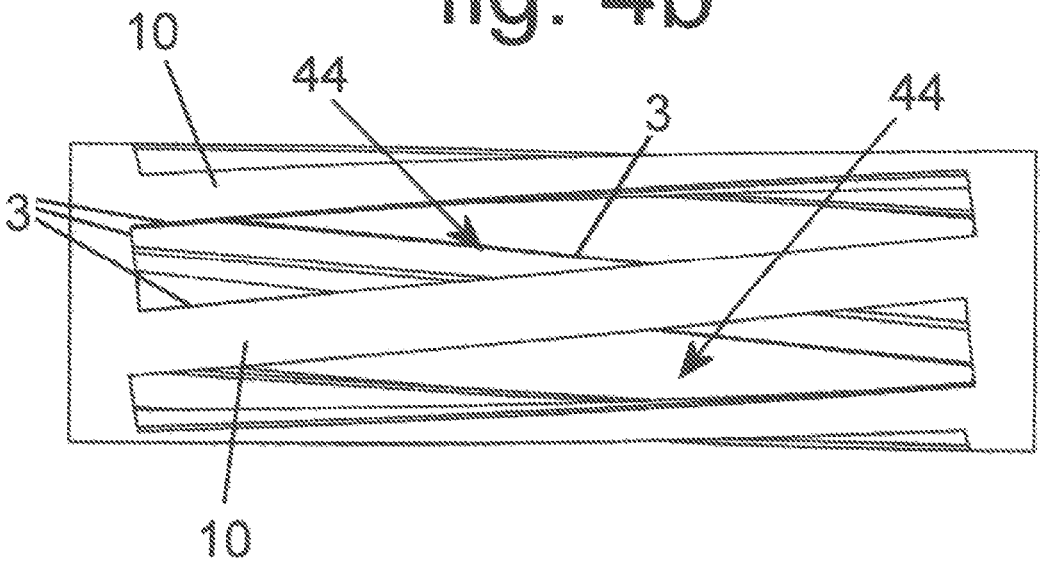

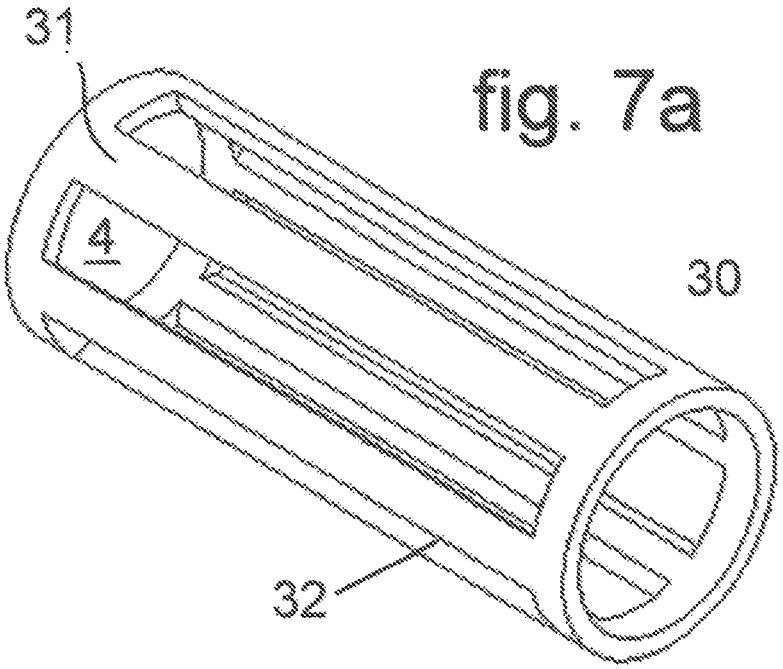
fig. 7a
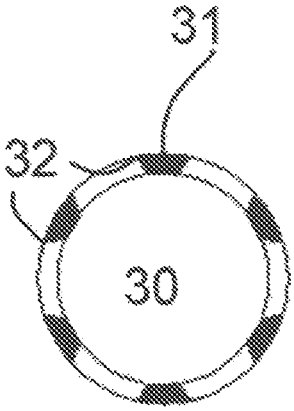
fig. 7b
fig. 7c
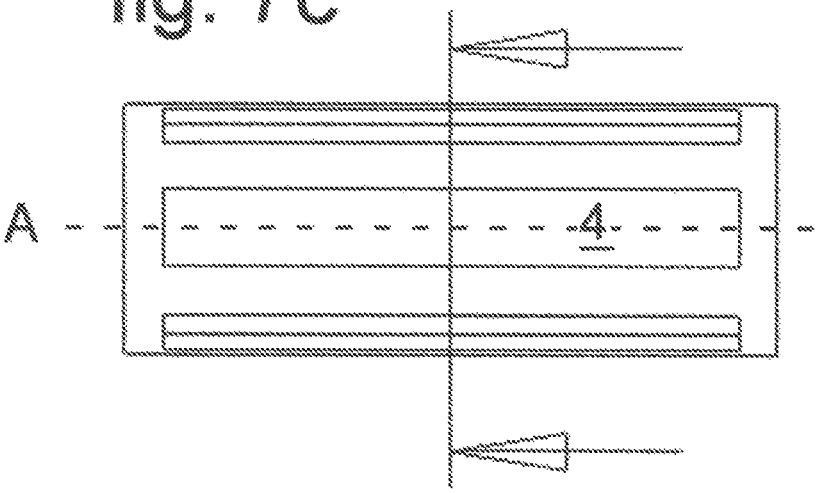

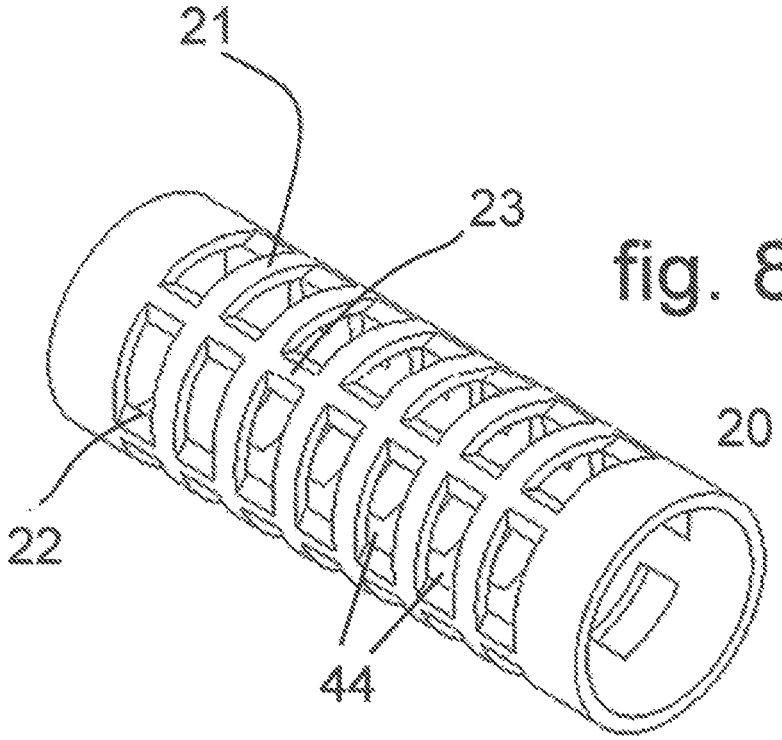
fig. 8a
fig. 8b
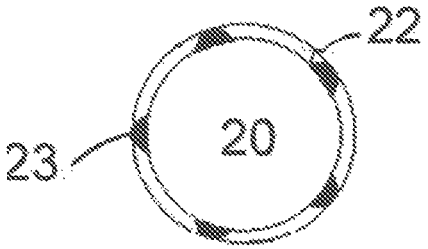
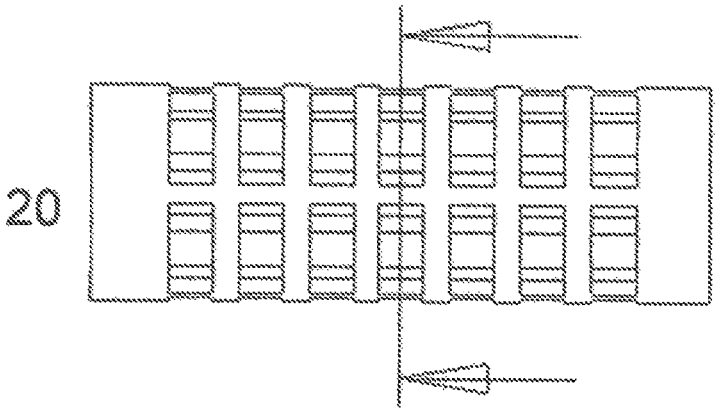
fig. 8c

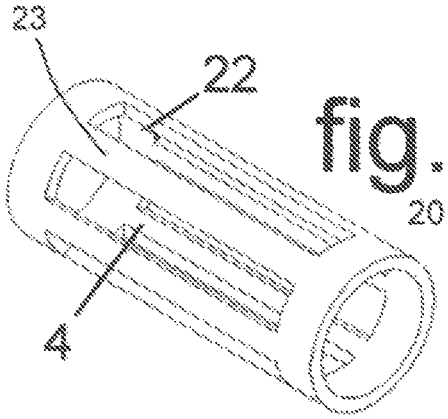
fig. 9a
fig. 9b
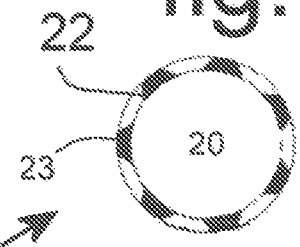
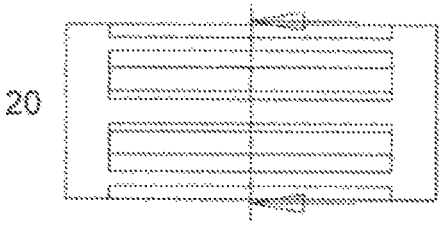
fig. 9c
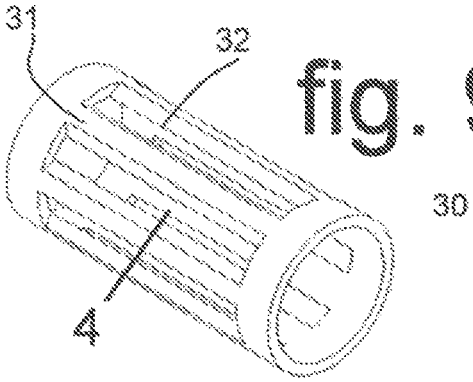
fig. 9d
fig. 9e
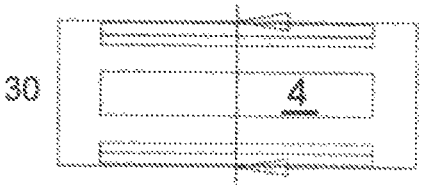
fig. 9f
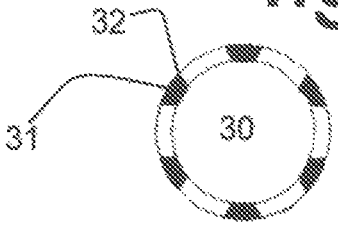

HAIR TRIMMING DEVICE

FIELD OF INVENTION

The present invention relates to a hair trimming device for trimming and cutting hair. More particularly, but not exclusively, the invention relates to a hair trimming device for trimming beards and cutting facial hair.

BACKGROUND

Personal grooming can be time consuming for people with beards as maintaining a given length of facial hair without clean shaving, may entail regular visits to a barber. This requires time and can be expensive. Some people may also prefer to wear a short beard, sometimes referred to as stubble, rather than allow facial hair to grow to an extended length. Maintaining such shorter beards in a tidy and neat form can be particularly time consuming.

Existing devices for trimming facial hair tend to be electrically operated and are typically arranged with reciprocating blades. They are sometimes referred to as clippers and their use can result in hair clippings or trimmings being dispersed during operation. They are also expensive to purchase, require a source of power (mains electricity or battery) and are often imprecise, as many individual hairs or even areas of hair, may be missed during use and so not properly trimmed to the same length as surrounding hairs. This can lead to frustration as the user becomes aware of differing lengths of facial hair and rarely has a chance to address this.

PRIOR ART

GB 2 544 155 (MOUNT) discloses a hair cutting device comprising a rotatable cartridge of blades and a counter rotating guide member.

CN 2 328 486 (XINTIAN) discloses a hair cutting device with a central blade cartridge, a coaxial perforated foil and a handle extending from and arranged to rotate about its axis.

WO 2016/108224 (BARAK) discloses a hair shaving device with a cutter assembly.

U.S. Pat. No. 1,543,387 (KAWALLE) discloses a safety razor with a rotary member having a plurality of spiral blades.

GB 511672 (KORTEN) discloses dry shaving machines with a guard plate and a plurality of rectilinear hair receiving slots.

U.S. Pat. No. 3,494,031 (SKLENAR) discloses an electric shaver having radially mounted T-shaped double-edged shaving blades.

U.S. Pat. No. 4,884,338 (STEWART) discloses an improved cutter head design for powered shavers.

The present invention arose in order to overcome problems associated with prior art devices.

An aim of the present invention is provide a cheap, reliable and portable hair trimming device which is manually operated and so does not require a source of power.

SUMMARY OF THE INVENTION

According to a first aspect of the present invention there is provided a manually operable hair trimming device comprises: a barrel which is rolled over hair to be trimmed, the barrel has at least one aperture through which hair is able to protrude; a first cutting blade is provided inside the barrel, the first cutting blade is held to prevent rotation with respect to the barrel; and a second cutting blade is associated with the barrel; whereby in use, as the barrel is rolled over hair to be trimmed, hair protrudes through the at least one aperture and is cut by a shearing force between relatively moving first and second cutting blades.

According to a second aspect of the present invention there is provided a manually operable hair trimming device comprises: a barrel with at least one aperture through which hair to be trimmed protrudes; a first cutting blade is provided inside the barrel and is driven by a drive means that rolls over hair to be trimmed in order to drive the first cutting blade; and a second cutting blade is associated with the barrel; whereby in use, as the device is rolled over hair to be trimmed, hair protrudes through the at least one aperture and is cut by a shearing force between relatively moving first and second cutting blades.

In this way a preferred embodiment of the hair trimming device can be rolled over a user's skin in order to trim hair. For example the device may be rolled over a beard or along a user's leg in order to trim the length of hair.

The barrel or the first cutting blade is be driven by contact with the user, such that the device is usable without a power source. In this way the device may be used out and about to remedy any incorrect hair length areas tidily and discretely.

The length to which the hair is cut is determined by the distance from an outer face of the barrel to the cutting point between the two cutting blades. Advantageously the grade of the device can be changed by altering this distance, for example by increasing thickness of the barrel or location of the cutting point.

The first and second cutting blades are preferably arranged on a single axis. Cutting may be enabled in several ways as detailed below. In every arrangement the cutting blades are arranged to move relative to one another so as to pass each other to create a cutting point.

The second cutting blade may rotate with the barrel whilst the first cutting blade is stationary. The second cutting blade is driven by being rolled across the hair which causes the barrel and thereby the second cutting blade(s) to rotate so that the second and first blades align to perform a cut.

The first cutting blade may rotate within the barrel whilst the second cutting blade is stationary. For example a drive means may drive the first cutting blade, the drive means arranged to engage with the hair as the device is rolled over the user, with the drive means rotating whilst the barrel remains static.

The drive means is manually powered and may include an externally mounted wheel or wheels for driving the first cutting blade and/or a wind-up spring (clockwork) drive.

In one embodiment of the device that includes a drive means for the first internally arranged cutting blade, the outer barrel may have a different cross sectional shape to that of a path traversed by the first cutting blade, so that the surface of the barrel and a path traversed by the first cutting blade are offset one from another or eccentric. This configuration of different distances between the cutting blades enables differing lengths of hair to be cut in dependence upon the angle or orientation at which the trimming device is used.

For example the outer barrel may have a D-shaped cross section so that the cylindrical first cutting blade that rotates inside the barrel, is offset and it is possible to cut hair at various lengths depending upon at which point, on the D-shaped cross section barrel, a hair is inserted through an aperture. In this way by tilting the trimming device at a desired angle, a user may select which region of its outer surface contacts the beard in order to cut different regions to different lengths.

The cutting blades may counter-rotate. For example the device may have a gearing system that permits the cutting blades to rotate in different directions to one another.

In a particularly preferred embodiment of the invention the barrel has a plurality of apertures through which hair can pass as the device is rolled over the hair by the user. Each aperture provides an opening through which hair can pass in order to be presented to the cutting blades. Each aperture is associated with a cutting blade such that hair accepted through any aperture on the barrel surface, can be cut cleanly. Therefore in a device with multiple apertures there are multiple cutting points. The result is that hairs are cut at the same length.

Another advantage of the hair trimming device is that because the device is relatively small and lightweight, it can be rolled in different directions and orientations across the surface of hair to be trimmed so as to ensure that hairs growing in different directions are caught and trimmed. This helps overcome the problems of differing lengths of facial hair being left untrimmed.

In some embodiments an edge of the aperture provided on the barrel may be shaped to provide the second cutting blade. For example the aperture may have a bevelled edge tapering to define a blade tip at the inner face of the barrel. In this way the blade is substantially enclosed to prevent injury to a user. Typically the apertures are sized such that a user cannot pass their fingers through and engage with the blades.

In an alternative embodiment the second cutting blade or blades is/are arranged on an inner face of the barrel. For example blades may be mounted on the inner face of the barrel so as to project from the barrel towards the first cutting blade.

Movement of the first and second cutting blades relative to each other mean that the blades intermittently align during rotation of the barrel, or the first cutting blade, to provide an opening through an aperture through which hair can pass and be presented to a cutting point at which point the cutting blades pass one another so that hair can be cut.

Preferably the first and second cutting blades are shaped and tapered in opposite directions so as to define scissoring edges.

Typically the ends of the device are held during use. For example the ends of the first cutting blade may be held such that holding the ends prevents rotation of the first cutting blade but still permits rotation of the barrel, thereby enabling cutting as the device is rolled over the hair.

Alternatively ends of the barrel may be held to prevent rotation of the second cutting blades and barrel and rotation of the first cutting blade is driven by a wheel or wheels that turns as the device is rolled over hair.

The second cutting blade(s) and first cutting blade(s) can counter-rotate with respect to one another.

In some embodiments the first cutting blade may be in the form of a second barrel arranged concentrically within the first barrel.

Part of the barrel is spaced radially from the cutting point by at least 1 mm and ideally by 3 mm.

Typically the barrel and first cutting blade are connected at distal ends whilst the mid sections of each are separated. In this way the barrel and first cutting blade are spaced apart. Advantageously this enables a user to cut hair to set lengths, regularly and reliably without possibility of cutting too short. Consequently in this way the device may provide an effective stubble maintenance device.

In some embodiments the barrel may accept or include a guide. The guide may provide spacing of the cutting point and contact surface (skin/hair of a user) so as to increase the length to which hair is cut.

The guide may also assist with guiding hair to and through the apertures on the surface of the barrel and/or against the cutting point.

In some embodiments the guide is displaceable therefore the guide can be added, removed and/or exchanged depending upon desired length for hair to be trimmed.

Preferably the guide may be arranged on the outer surface of the barrel. The guide may comprise clip-on or clip-over adaptor for the outer barrel.

In some embodiments the outer barrel comprises an integrated guide. This guide may be secured permanently on the outer surface of the outer barrel, or comprised by the formation of the outer surface of the outer barrel, for example wherein the outer barrel has raised and lowered parts arranged to reduce the outer contact surface of the barrel, with the user or reduce its surface area. Advantageously this allows the device to pass over the hair without substantially flattening the hair.

The guide may comprise sequentially raised and lowered portions in or of the outer surface. For example the guide may comprise circumferential ribs. The guide may comprise thermoplastics and/or provide a smooth or glossy finished outer surface. The guide may be clip-on over the barrel(s).

In some embodiments the outer surface of the barrel may comprise a resiliently deformable material arranged to grip, catch or guide strands of hair into a preferred position for cutting.

Advantageously the guide may also serve to provides a reduce contact surface area with the user meaning the hair is less likely to be flattened.

The guide may also serve to increase surface friction to promote rolling of the device. For example the outer surface of the barrel may comprise a silicone or similar material arranged to catch hair and drag it into the apertures, and into the cutting point and/or which material is deformed under pressure or contact with the face, so as to provide friction to drive the outer barrel or blade(s).

The guide can also space the contact surface from the cutting point, thereby increasing the length to which hair is trimmed. The guide also reduce the surface area of the device which is in contact with a user's skin and/or hair.

For example the outer surface of the barrel may include projecting nodes. The nodes preferably extend circumferentially. In this way the cutting point may be provided with a guide to guide hairs as well as an edge to cut against. In addition or the alternative the nodes may act to lift or scoop hairs, wherein as the outer surface rotates the outer surface is driven by the contact surface and the nodes advantageously contact the user firstly so as to lift the hair for example as the device is rolled down the face and the outer surface drives counter-rotation of the outer barrel.

In some embodiments the outer barrel or guide may comprise a discontinuous outer surface, which outer surface may consequently advantageously limit contact with the user and limit flattening of hair, and maximise cutting opportunities during rotation.

In some embodiments the guide may comprise a mesh, which mesh acts to further space the contact surface from the cutting point as well as providing a reduced surface area of contact surface.

In some embodiments the device may include a comb section which is a section that overhangs the cutting blade associated with the outer barrel so as to direct hair to the cutting point and to aid a clean cut without snagging. For example the comb section is preferably circumferentially offset from the tip of the second cutting blade. This may be to either side, such that the comb overhangs the cutting point in either direction of rotation. The comb or comb section may be part of the barrel or a part fixed to the barrel or apertures.

In some embodiments at least some of comb overhangs at least some of the apertures. This may advantageously enable the user to scoop up hairs into the apertures.

The device advantageously comprises modular parts so that it can be readily disassembled. This is especially advantageous as it enables cleaning, maintenance and replacement of parts, such as blades and cutting points or bearings.

Preferably the barrels may be concentric and arranged to be rotatable about one another. Advantageously this feature enables the device to be used in any direction on the user, as well as simultaneously allowing rotation in any direction.

In some embodiments the cutting blades may rotate about an axle or spindle.

Optionally therefore embodiments may comprise two mutually rotatable concentric barrels, defined as an inner barrel and an outer barrel, and a guide; the inner barrel comprising a drive means and the barrels each being associated with blades, wherein the outer barrel has a guide.

The barrels may be arranged to cut at a cutting point between the inner surface of the outer barrel and the outer surface of the inner barrel, wherein the outer surface of the outer barrel, or comb outer surface, is spaced by a haircutting grade from the cutting point.

The barrels are provided with apertures through which hair passes to be cut. In some embodiments the first cutting blade is a second inner barrel provided with apertures that intermittently match up with apertures on the first barrel (outer barrel)| during rotation.

It is appreciated that the aperture or apertures may comprise slots, which may be parallel the axis, toothed or helical.

In some embodiments the outer barrel includes a plurality of blades optionally arranged at different angles.

The apertures may have shaped edges such as tooth or scallop edges to help catch and guide hair.

In some embodiments the inner barrel provides a plurality of blades.

Preferably the device has a hollow centre where cut hair can gather for disposal later. Advantageously the ends serve to close the hollow centre. When an end is removed hair can be emptied.

In some embodiments the first cutting blade may be connected to a central axle.

In some embodiments the device may include a handle. Preferably the handle is connected to the ends, either of the barrel or first cutting blade such that rotation of one of these parts is restricted or driven by the handle.

In a preferred embodiment having a handle the handle is U-shaped. The U-shaped handle is connected to a lead screw that is connected to the first cutting blade. The handle may be sprung such that the handle can be squeezed or levered to drive the lead screw to rotate the first cutting blade. When the handle is released the handle returns to the first orientation.

The lead screw may be associated with the end caps. In some embodiments the cutting point may comprise cutting points in a helical arrangement. For example the barrel may have apertures in a helical arrangement and the aperture edges are formed as blades.

In some embodiments the cutting blades may comprise a toothed cutting point, which may provide a plurality of angles of cut, and a more random and/or continuously active cutting surface.

In some embodiments the cutting point may comprise a helical and a toothed cutting point intermittently, for example wherein the inner and outer barrel apertures differ.

The apertures may comprise a honeycomb arrangement, so as to stagger the cutting point in use, and limit pulling.

In some embodiments the device may comprise a guard to limit ingress of hair or skin into the apertures, which guard may be provided by the guide or may comprise a further part radially distant or proximal the outer surface. For example in some embodiments wires may be arranged to periodically cross apertures so as to limit ingress of skin or hair.

The apertures may be shaped for more effective provision of a cutting point, for example wherein the apertures are bevelled to provide meeting blades at the cutting point. The apertures may have razor blades bonded to their edges.

In some embodiments the apertures may be varied across a barrel. For example in some embodiments the apertures may comprise an aperture for precise cutting, and/or lifting of stubborn hair for cutting.

The barrel may have a solid core, wherein the blades sit in longitudinal slots.

Preferred embodiments of the invention will now be described with reference to the Figures in which:

BRIEF DESCRIPTION OF FIGURES

FIG. 3A shows an end view of the embodiment shown in FIG. 1, and FIG. 3B shows a side view of the embodiment shown in FIG. 1;

FIG. 4A shows a side view of the embodiment of the outer barrel shown in FIG. 1, and FIG. 4B shows a view of the embodiment of the inner barrel shown in FIG. 1;

FIG. 7A shows an isometric view of third embodiment of an inner barrel for use in a device according to the present invention, FIGS. 7B and 7C show a sectional view and a side view of the embodiment of the inner barrel as shown in FIG. 7A;

FIG. 8A shows an isometric view of the third embodiment of an outer barrel for use in a device according to the present invention, FIGS. 8B and 8C show a sectional view and a side view of the embodiment of the outer barrel as shown in FIG. 8A;

FIG. 9A shows an isometric view of a fourth embodiment of an outer barrel for use in a device according to the present invention;

FIGS. 9B and 9C show a sectional view and a side view of the embodiment of the outer barrel as shown in FIG. 9A, FIG. 9D shows an isometric view of an embodiment of an inner barrel for use in a device according to the present invention;

FIGS. 9*e* and 9*f* show a sectional view and a side view of the embodiment of the inner barrel as shown in FIG. 9D;

DETAILED DESCRIPTION OF THE EMBODIMENT

Figure 1:
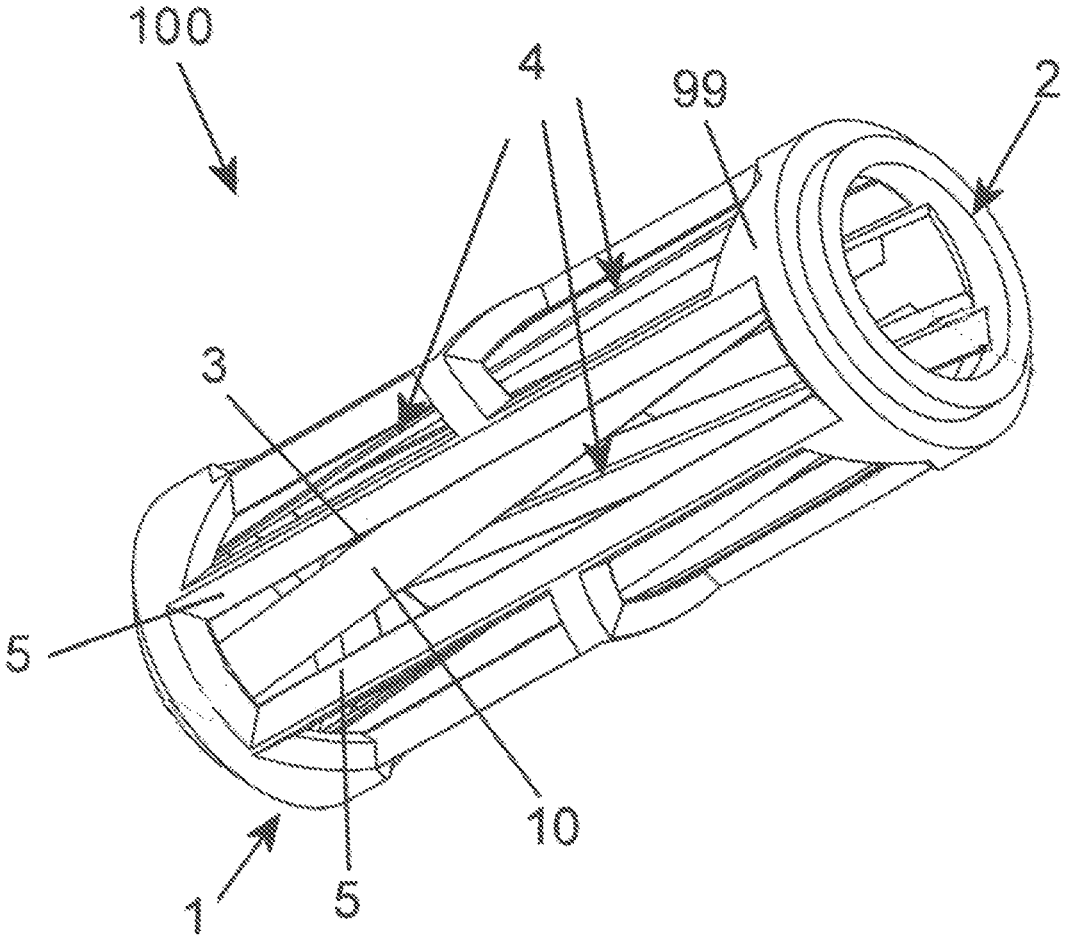
FIG. 1 shows an isometric view of a first embodiment of the device according to the present invention.
Figure 2:
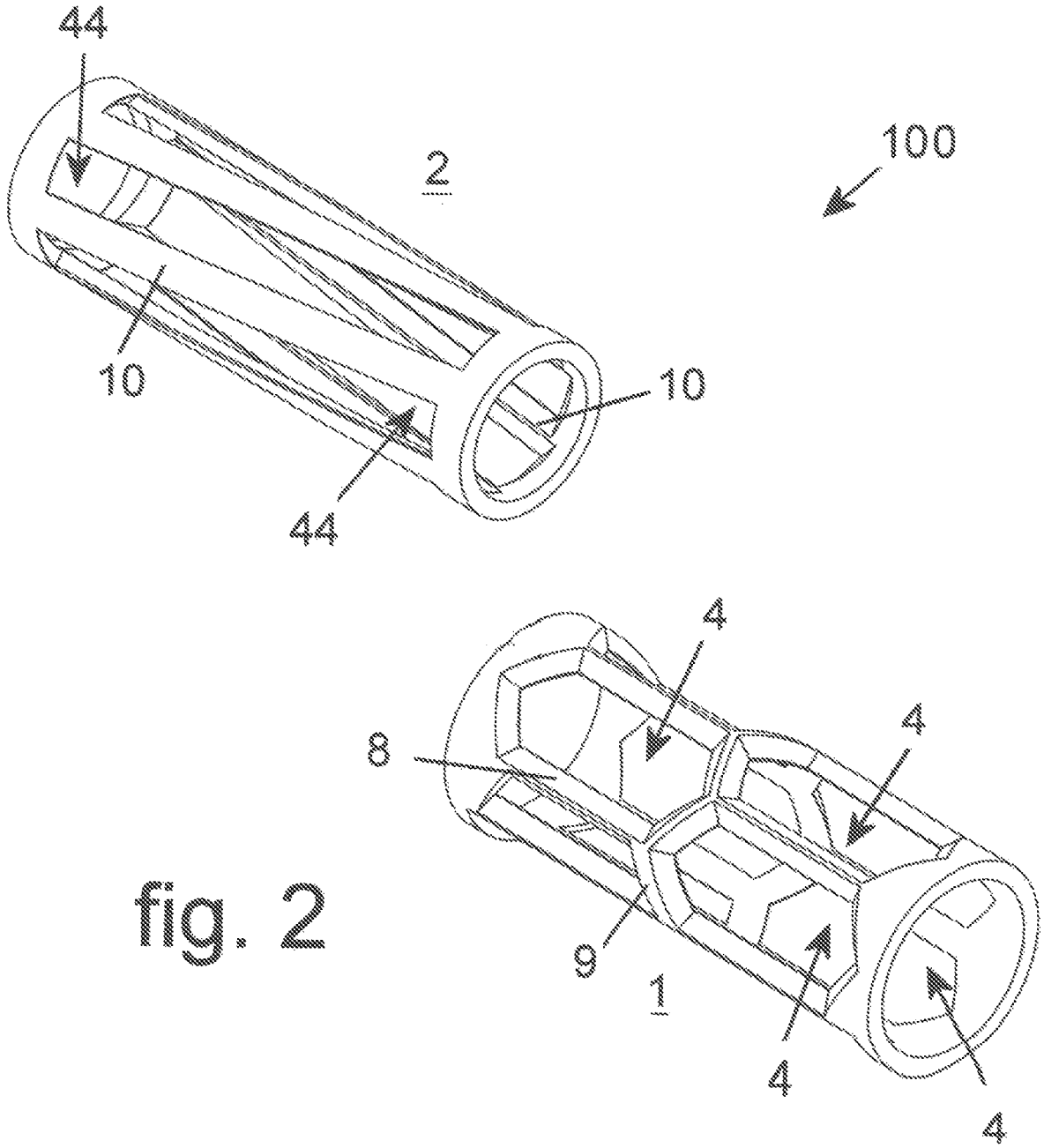
FIG. 2 shows an exploded isometric view of the embodiment shown in FIG. 1.

With reference to FIGS. 1 to 5 there is shown an embodiment of a manually operable hair trimming device 100 comprising a first inner cutting blade 2 and a barrel 1 associated with and comprising a plurality of second cutting blades 5.

The barrel 1 is a hollow cylindrical body with a plurality of apertures 4 formed through its curved outer surface. The barrel 1 comprises longitudinal cylindrical cavity extending between the opposite planar faces of the barrel, within which the first cutting blade 2 is located. The apertures 4 formed through the barrel 1 connect the exterior of the barrel 1 to the cylindrical cavity within which the first cutting blade is located. The side walls of the apertures 4 are bevelled from larger openings on the exterior of the barrel 1 to narrower openings on the interior of the barrel. Edges of the apertures 4 comprised by the barrel 1 form the second cutting blades 5. The cutting edges of the second cutting blades 5 being defined by the boundaries between longitudinal side walls of the apertures 4 and the cylindrical wall of the interior or the barrel 1.

The first cutting blade 2 is a hollow, substantially cylindrical body. A plurality of apertures 44 formed through the curved surface of the body, the edges of which define cutting edges of the first cutting blade 2. The first cutting blade 2 defines a second barrel that is arranged within the first barrel 1. The first cutting blade 2 is located within the cylindrical aperture formed through the barrel 1.

The first cutting blade 2 has a greater length than the barrel 1 such that it extends from the ends of the barrel 1. In use, the ends of the first cutting blade 2 which extend from the barrel 1 may be held, for example by a user, such that as the barrel 1 is rolled over a surface, the barrel 1 is rotated around the first cutting blade 2. The first cutting blade 2 is therefore in the form of second barrel 2 has a plurality of apertures 44 whose edges define the blade 10.

The first barrel 1 and the first cutting blade 2 are rotatable about a shared longitudinal axis A (see FIG. 3B), about which they are coaxial and concentric.

The outer surface of the substantially cylindrical first cutting blade 2 being at a radius from the shared axis A approximately equal to, or slightly less than the radius of the inner surface of the barrel 1.

The apertures 4, 44 of the barrel 1 and the first cutting blade 2 rotate with respect to each other around the shared axis A in use. The edges of the apertures 4, 44 intermittently align and pass each other during rotation to mutually provide a cutting point 3 at which the cutting edges of the second cutting blades 5 and first cutting blade 2 pass each other and perform a cut by shearing force.

The barrel 1 has a curved cylindrical outer surface 99, the side walls of the apertures 4 being sloped such that the portions of the outer surface 99 between the apertures 4 are narrower than the portions of the interior cylindrical surface of the barrel 1 between the apertures 4. This ensures that the walls of the apertures 4 are bevelled and slope into the cutting edge of the second cutting blades 5 such that and the angle between the curved inner surface of the barrel 1 and the side wall of the apertures 4 at the cutting edge of the second cutting blades 5 are acute that may assist hair entry.

In the illustrated embodiment, the barrel 1 and the barrel shaped first cutting blade 2 are formed from stainless steel. It is appreciated that other materials may be uses such as alternative metals, metal alloys or ceramics.

The barrel 1 and barrel shaped first cutting blade 2 are concentric and closely fitted. Further embodiments may comprise first cutting blade 2 which is not barrel or cylindrical shaped, for example they may comprise a sprung and/or discontinuous and/or C-shaped first cutting blade 2.

The first outer barrel 1 has a plurality of differently shaped apertures 4, these include a rectangular aperture 4A, hexagonal apertures 4B and trapezoid shaped apertures 4C. The apertures 4 are arranged in a tessellated pattern that covers the majority of the curved surface of the cylindrical barrel 1. Individual apertures are separated by portions of the barrel 1 which define the second cutting blades 2.

The apertures 4, 4A, 4B, 4C of the first outer barrel 1 have bevelled edges that define the second cutting blades 5.

Apertures 4B and 4C are arranged in a staggered honeycomb pattern around the majority of the outer surface 99 of the first barrel 1. The rectangular aperture 4A breaks this pattern and forms a slot, extending between opposite ends of the barrel, that may be used for lifting hair and cutting lifted hair.

The hexagonal and trapeze shaped apertures 4B, 4C comprises bevelled sides and associated cutting edges which are parallel to the shared axis A, as well as bevelled sides and edges which are at acute/obtuse angles to the shared axis A. As these edges and cutting sides are not at right angles to the shared axis A, they advantageously provides effective side cutting points 3. The bevelled sides and edges at acute/obtuse angles to the shared axis A define zig-zag cutting edges around the ends of the barrel 1 and around the centre of the length of the barrel 1.

Figure 5:
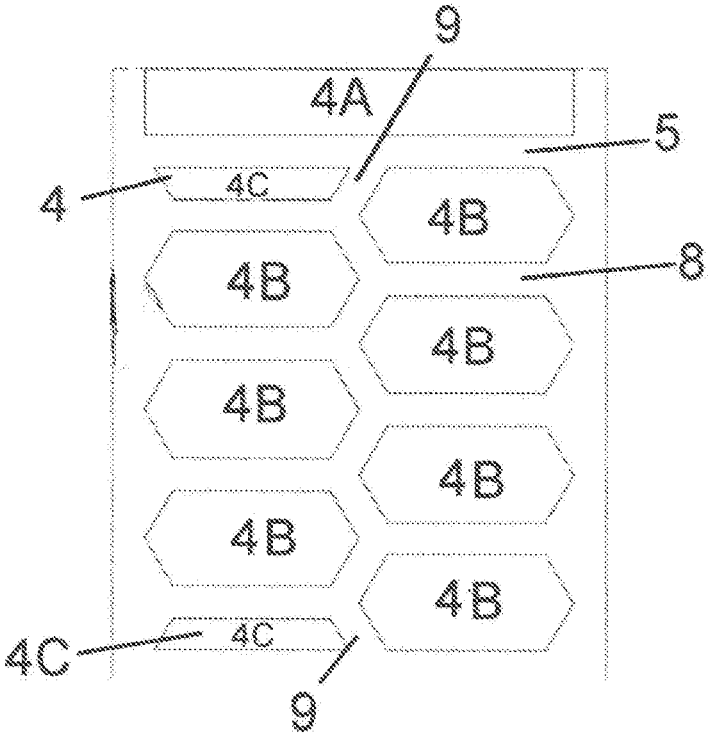
FIG. 5 shows a diagrammatic view of the apertures of the embodiment of the outer barrel shown in FIG. 4A.

The apertures 4 on the first outer barrel 1 are separated by 3 mm thick bevelled portions 8, 9 of the curved wall of the barrel, which define second cutting blades 5 (see FIG. 3B and FIG. 5).

The hexagonal apertures 4B are approximately 9 mm in width, and have side walls bevelled at 45 degrees. The vertices of the hexagonal apertures 4B are at obtuse angles of 120 degrees.

The first cutting blade 2 has diagonally arranged rectangular apertures 44, which extend helically about the second inner barrel 2 which defined the first cutting blade 2. The longer edges of the rectangular apertures 44 are at angles of 7 to 8 degrees to longitudinal axes of the substantially cylindrical first cutting blade 2, and the shorter edges of the rectangular apertures 44 are at angles of 82 to 83 degrees from longitudinal axes of the first cutting blade, such that the diagonal angle of the rectangular apertures 44 is between 7 and 8 degrees. A preferred range is between 8 and 20 degrees.

FIG. 5 shows a diagrammatic flat view of the barrel. FIG. 5 also represents an example of a planar sheet of stainless steel that is rolled to form the first outer barrel 1 shown in FIGS. 1 to 4.

Figure 6:
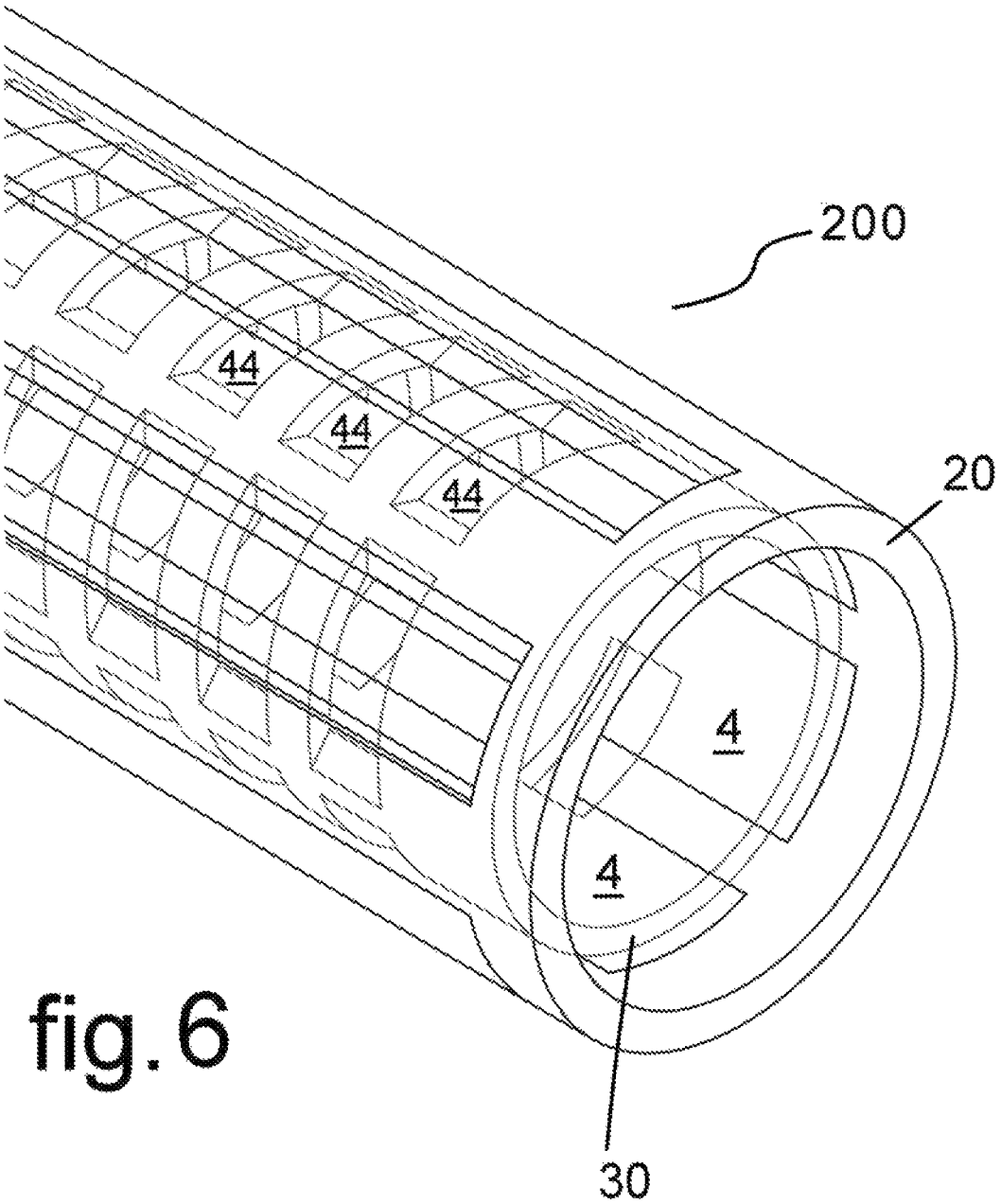
FIG. 6 shows a partial isometric view of inner and outer barrels for a second embodiment of the device according to the present invention.

FIG. 6 shows a second embodiment of the hair trimming device 200. The second embodiment of the device 200 also has two barrels 20, 30 that have apertures 4, 44 that have edges that define the cutting blades.

The outer barrel 20 is arranged concentrically around the inner barrel 30. In FIG. 6 the outer barrel 20 has rectangular slots 4 running in the same direction as the Axis A. The inner barrel 30 has rectangular apertures 44 that are arranged perpendicular to the apertures 4 on the outer barrel.

Longitudinal bevelled edges of the elongate rectangular apertures 4 formed though the outer barrel define cutting edges of second cutting blades, and longitudinal bevelled edges of the rectangular apertures 44 formed through the inner barrel 30 define cutting edges of the first cutting blade.

FIGS. 7 and 8 show a third embodiment of a hair trimming device in which the barrels described in FIG. 6 are reversed. Therefore, the smaller rectangular apertures 44 are provided on the outer barrel 20 and the elongate rectangular slots 4 are provided on the inner barrel 30.

Therefore, the smaller rectangular apertures 44 define the second cutting blades and the elongate rectangular slots 4 define the first cutting blade.

The inner barrel 30 has elongate rectangular apertures 4 defined and separated by runners 31 as shown in FIG. 7.

Blades 32 are defined on both sides of the runners 31, as the runners 31 taper to a thinner inner surface, to a wider outer surface, thereby forming a sharpened edge between the tapered side wall of the slot 4 and the outer face of the inner barrel 30.

In FIG. 8 the outer barrel 20 has a plurality of rectangular apertures 44 that run perpendicular to the axis A of the barrels 20, 30. Runners 21 and 23 separate and define the apertures 44. The runners 23 taper from a wider edge at the inner surface of the outer barrel 20, to a narrower face at the outer surface of the outer barrel, such that the associated side faces of the apertures 44 are bevelled to define cutting edges of the second cutting blades 22.

The points at which the edges of the second cutting blades 22 and the first cutting blade 32 pass define the cutting points.

In both the second and third embodiments the outer diameter of the inner barrel 30 is substantially equal to the inner diameter of the outer barrel 20, such that the barrels provide a close tolerance between them. The barrels 20, 30 engage at their ends so as to be in contact with one another at the ends in such a way as to permit rotation.

FIGS. 9*a* to 9*f* disclose a fourth embodiment of the hair trimming device. Similarly to the second and third embodiment, the device has two concentric barrels 20, 30, however both barrels 20, 30 have elongate, rectangular slot apertures 4.

The outer barrel 20 shown in FIGS. 9A to 9C comprises apertures 4 through the barrel walls between runners 23. The runners 23 taper from relatively wide inner faces to relatively narrow outer faces, thereby providing the blades 22 which comprise cutting edges between the sloped side walls of the apertures 4 and inner cylindrical wall of the outer barrel 20.

In FIGS. 9D to 9F disclose the inner barrel 30 that also includes apertures through the barrel 30 walls defined between runners 31. The runners 31 taper from relatively wide outer faces to relatively narrow inner faces so as to define blades 32 with cutting edges between the sloped walls of the aperture and the outer faces of the runners 31 comprised by the outer cylindrical wall of the inner barrel 30.

Figure 10:
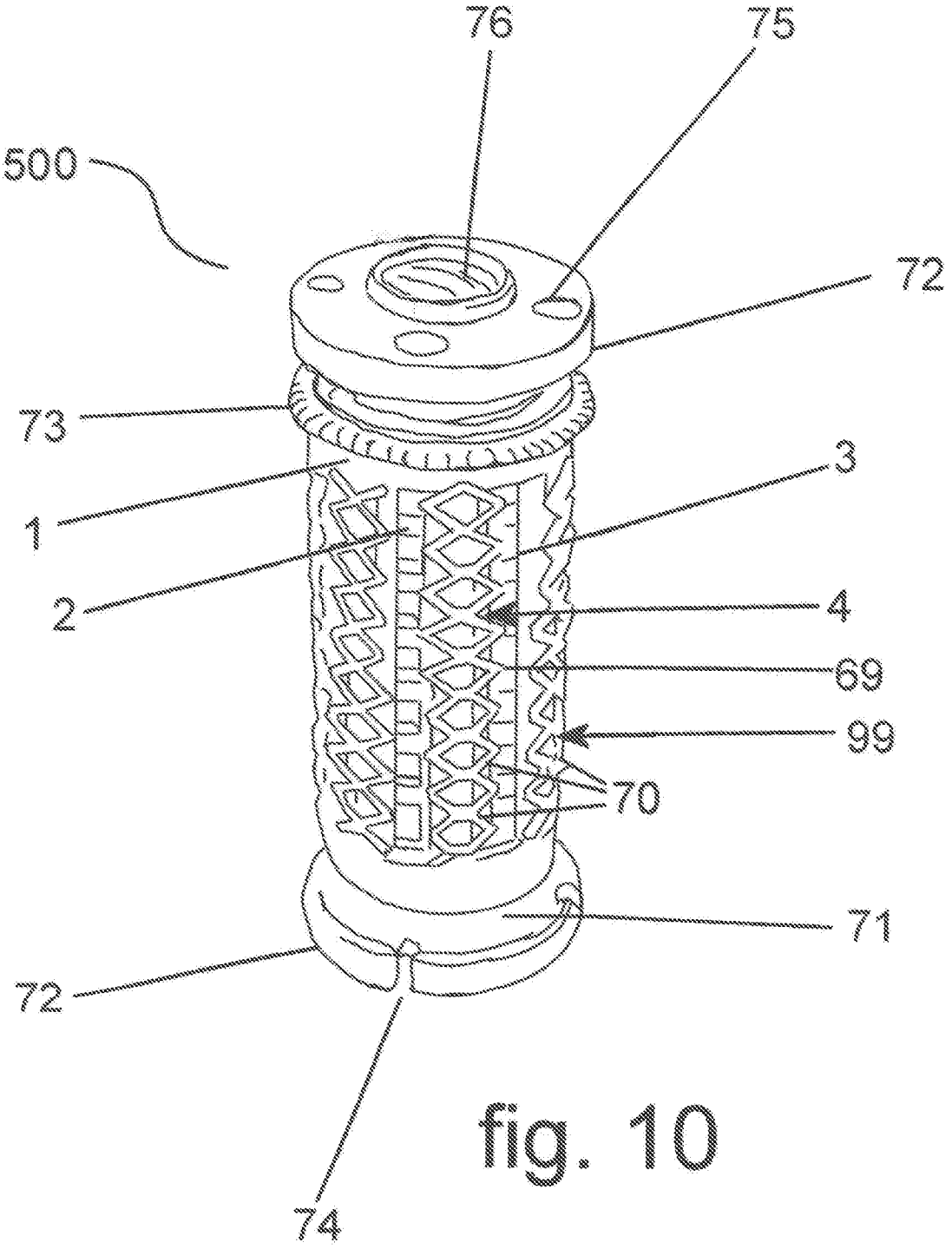
FIG. 10 shows a sketch of an isometric view of a fifth embodiment of a device according to the present invention.

With reference to the embodiment shown in FIG. 10 there is shown a fifth embodiment of the invention. The outer surface 99 of the device 500 has a guide 70 that guides hair to the cutting points.

The fifth embodiment has two barrels 1, 2, an inner barrel 2 that comprising the first cutting blade and an outer barrel 1.

The inner barrel 2 is longer than the outer barrel 1, such that the barrels are enabled to slide axially in use. In this way, blocked hairs may advantageously be dislodged from between the barrels. This length differential may be reversed in other embodiments, such that the inner barrel 2 is shorter than the outer barrel 1.

The barrels extend between distal end caps 72, provide a drive means to allow the user to hold the inner barrel 2 and to limit rotation as well as permitting a user to rotate the inner barrel 2 by adjusting their hand position, as the outer surface 99 rotates against the user's face and drives the outer barrel 1 to rotate.

The outer barrel 1 comprises a drive ring 73, which enables the user to drive rotation of the outer barrel 1, by running the drive ring 73 against the user. This can enhance rotation by ensuring the outer barrel 1 rotates over uneven surfaces such as the face.

The outer surface 99 is provided by a plurality of guide sections 70, which are comprised by mesh sections which are bonded to the outer surface of the outer barrel 1, between apertures 4.

The pictured embodiment comprises a diagonal mesh guide 70, with fingers 69 which extend over the aperture 4. In this way hair is caught by the guide and guided to the cutting point 3. The guide 70 reduces the contact area between the outer barrel 1 and the face. Hair is held against the guide 70 as it is cut by at the cutting point 3, thereby reducing any pulling force of the hair from the face.

The end caps 72 comprise lead screw threads 76, where a drive means, such as a series of gears, (not shown) arranged to drive a screw in the threads and rotate the inner barrel 2. The end caps further include holes 75, which may accept axially extending drive rods to aid in driving rotation of the inner barrel 2.

One of the end caps 72 comprises a keyed perimeter 74 to further aid manual driving. The opposing end cap is smooth, to aid in manual driving of the outer barrel 1 using the proximate drive ring 73.

In FIG. 10 the device 500 has resiliently deformable rubber O rings 71 at the ends of the barrels 1, 2 and between the end caps 72 and barrels 1, 2, which accept and limit axial movement.

Figure 11:
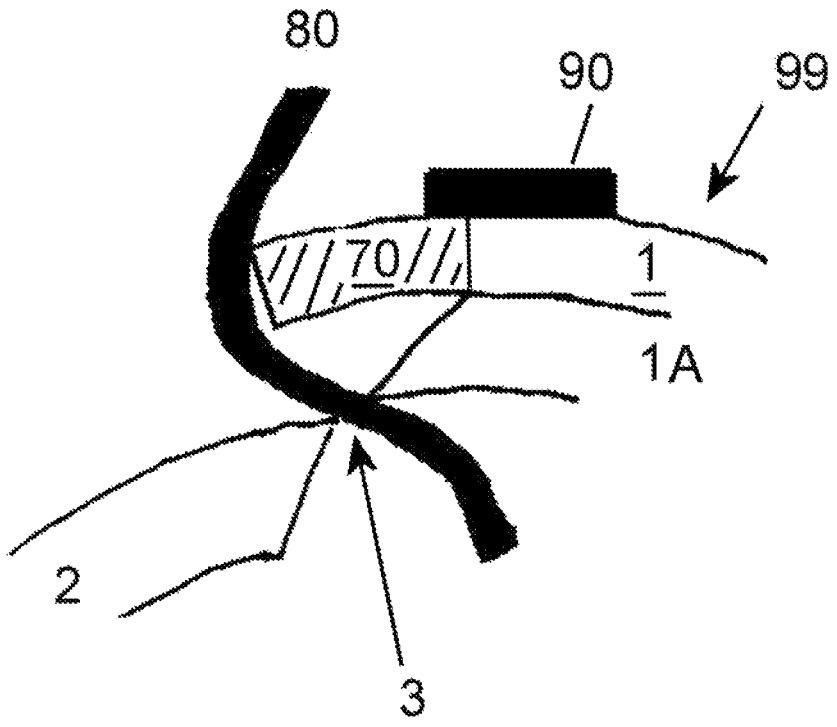
FIG. 11 shows a sectional view of a detail of an embodiment of the device according to the present invention, in use.

With reference to FIG. 11 the cutting point 3 is defined by the first cutting blade of the inner barrel 2 and the second cutting blade associated with the outer barrel 1. The second cutting blade 1A is arranged on an inner face of the outer barrel 1. Part of the outer barrel 1 overhangs the second cutting blade 1A to provide a comb 70 that overhangs the cutting blade 1A. The comb 70 forces the hair 80 to be bent across the blades 2, 1A to aid with cutting as well as providing a brace to the pulling forces involved in the cut.

The outer face 99 of the outer barrel 1 has resiliently deformable nodes 90 located thereon that aid driving of the rotation of the outer barrel 1 through friction, as well as improve comfort in use.

Figure 13:
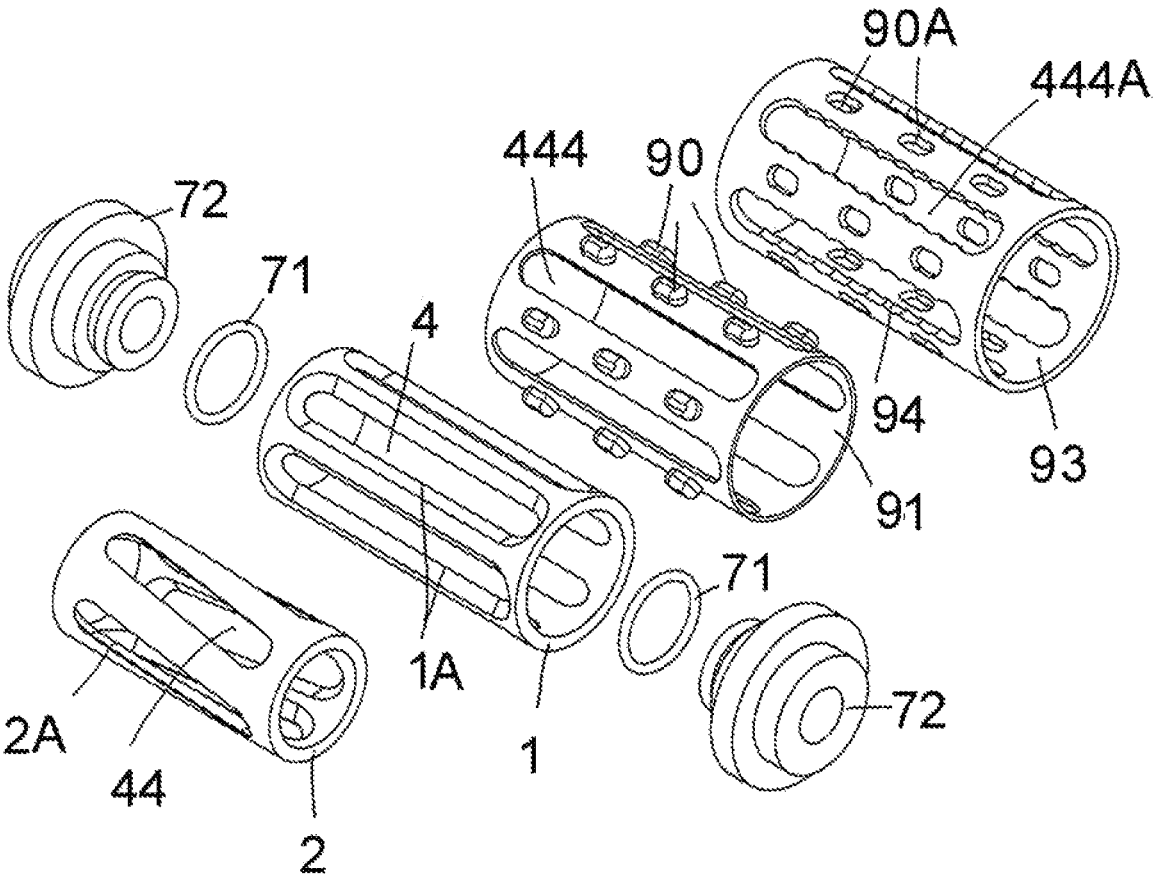
FIG. 13 shows an exploded view of the sixth embodiment.

In some embodiments, the nodes 90 may be part of a sleeve arranged inside the outer barrel 1 that has nodes 90 that project through apertures in the outer barrel 1 (As shown in FIG. 13).

Figure 12:
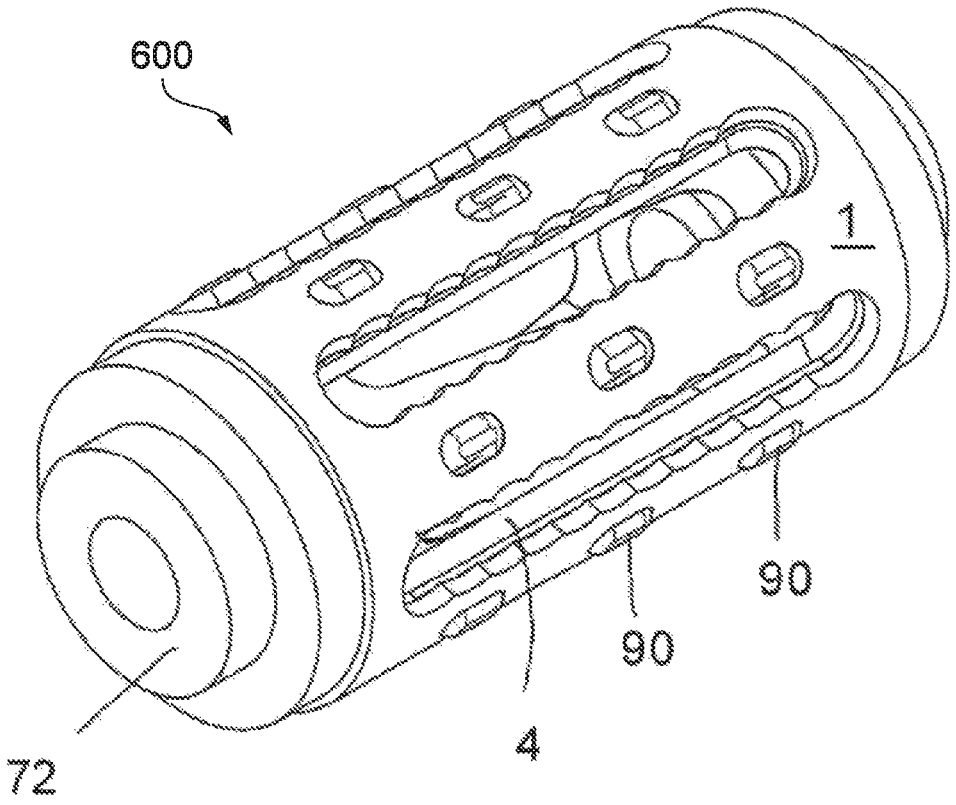
FIG. 12 shows a sixth embodiment of the device.
Figure 14:
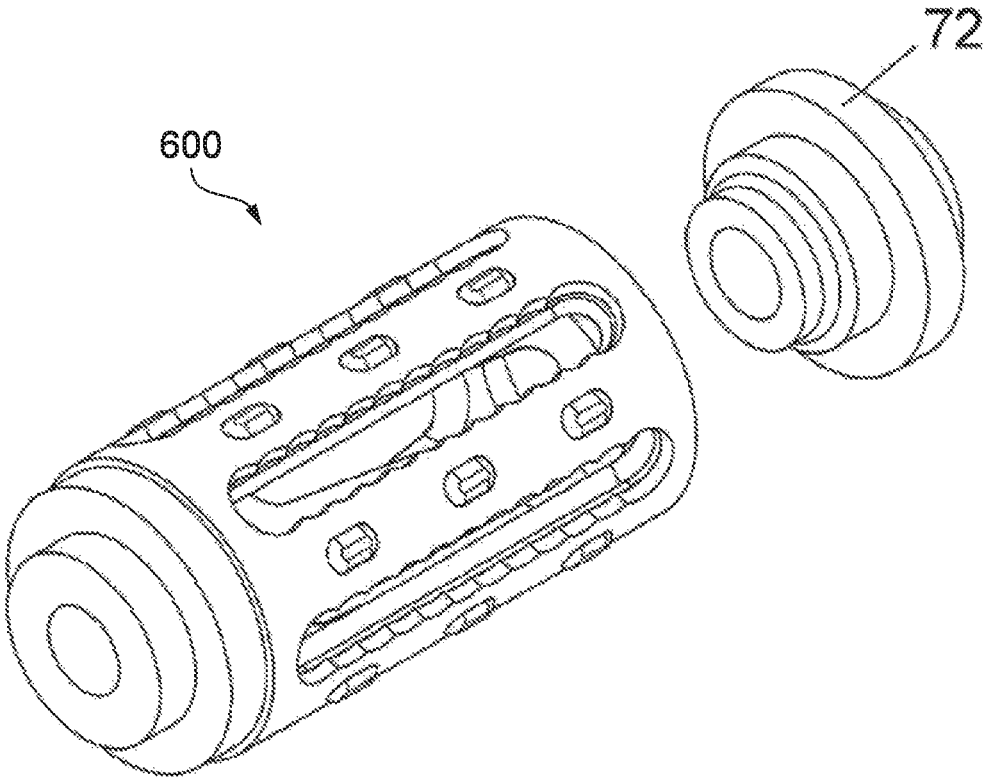
FIG. 14 shows an overview of the sixth embodiment with an end cap removed.

FIGS. 12 to 14 show a sixth embodiment of the hair trimming device. Like references from other embodiments have been used where appropriate.

The device 600 comprises a first cutting blade 2 arranged in the form of an innermost barrel, a second cutting blade 1A associated with an outer barrel 1, two end caps 72, a flexible sleeve 91 with nodes 90 and a cover 93. The first cutting blade 2, the outer barrel 1, the sleeve 91 and the cover 93 being substantially cylindrical, concentric and coaxial.

The first cutting blade 2 is a barrel with elongate stadium-shaped apertures 44 arranged about a barrel wherein the aperture edges are bevelled to form cutting blades 2A.

The second cutting blades 1A are defined by tapered runners between apertures 4 formed through the outer barrel 1. O-rings 71 are provided between the barrels 1, 2 and the end caps 72.

A resiliently deformable sleeve 91 is arranged over the outer barrel 1. The sleeve 91 has apertures 444 that correspond with the apertures 4 of the outer barrel 1.

The cover 93 has apertures 444A that correspond to apertures 4 and 444. The sleeve 91 and cover 93 are fixed to the outer barrel 1 and do not move independently of the barrel. Therefore, all three outermost cylinders 1, 91, 93 rotate about the first cutting blade 2 in unison as one part.

The sleeve 91 has nodes 90 that project through openings 90A in the cover 93. Edges of the cover apertures 444A have a toothed or scalloped edge 94 that serves as a catch to help grab and direct hair to the cutting point.

The apertures may be cut using a multi-axis laser tube cutting process at an acute angle off the radius on the inner barrel, and an obtuse angle off the radius on the outer barrel, so as to provide opposing bevel inclines and consequently blades for a scissor-action cutting point.

The outer barrel 1 and the first cutting blade 2 may comprise stainless steel, another metal or metal alloy or ceramic material arranged such that the blades may be sharpened or sharp, and water impervious. Advantageously this enables the device to be used in a damp environment as well as a dry environment.

The blades in the pictured embodiments of FIGS. 6 to 9 run parallel the barrel axis blades.

In some other embodiments, as shown in FIGS. 1 to 4 the blades may be helically slanted, toothed or crossed. In this way, more effective shearing may be accomplished, and/or a continuous cut across the length of the device may be achieved during rotation.

The invention has been described by way of examples only and it will be appreciated that variation may be made to the above-mentioned embodiments without departing from the scope of invention.

The invention claimed is:

1. A manually operable hair trimming device comprises:
- a barrel which is rolled over hair to be trimmed, the barrel has at least one aperture;
- a first cutting blade provided inside the barrel;
- a second cutting blade associated with the barrel; and
- a guide comprising raised parts arranged to space an outer contact surface of the barrel from a user's skin;
- whereby in use, as the barrel is rolled over the hair to be trimmed, hair protrudes through the at least one aperture and is cut at a cutting point by a shearing force between relative movement of the first cutting blade and the second cutting blade;
- wherein at least part of the barrel has a comb that overhangs the second cutting blade so as to direct hair and space the cutting point from the user's skin.

2. The manually operable hair trimming device according to claim 1 wherein an edge of the at least one aperture on the barrel defines the second cutting blade.

3. The manually operable hair trimming device according to claim 1 wherein the second cutting blade is arranged on an inner face of the barrel.

4. The manually operable hair trimming device according to claim 1 wherein the comb is provided on an edge of the at least one aperture, the comb being circumferentially offset from the second cutting blade so that the comb directs hair to the cutting point.

5. The manually operable hair trimming device according to claim 1 wherein an outer surface of the barrel is spaced radially from the cutting point by at least 1 mm.

6. The manually operable hair trimming device according to claim 1 wherein the raised parts are nodes that are resiliently deformable.

7. The manually operable hair trimming device according to claim 1 wherein the first cutting blade and the second cutting blade are shaped and tapered in opposite directions so as to define scissoring edges.

8. The manually operable hair trimming device according to claim 1 wherein the first cutting blade and the second cutting blade are formed from stainless steel.

9. The manually operable hair trimming device according to claim 1 further comprising at least one end cap.

10. The manually operable hair trimming device according to claim 9 wherein the at least one end cap is removable so as to enable removal of cut hair.

11. A manually operable hair trimming device comprises:
- a barrel with at least one aperture through which hair to be trimmed protrudes;
- a first cutting blade provided inside the barrel;
- a second cutting blade associated with the barrel; and
- a guide comprising raised parts arranged to space an outer contact surface of the barrel from a user's skin;
- whereby in use, as the device is rolled over the hair to be trimmed, hair protrudes through the at least one aperture and is cut at a cutting point by a shearing force between relative movement of the first cutting blade and the second cutting blade;
- wherein at least part of the barrel has a comb that overhangs the second cutting blade so as to direct hair and space the cutting point from the user's skin.

12. A manually operable hair trimming device comprising:
- a barrel which is rolled over hair to be trimmed, the barrel has at least one aperture;
- a first cutting blade provided inside the barrel;
- a second cutting blade associated with the barrel; and
- a sleeve fitted over the barrel,
- whereby in use, as the barrel and the sleeve are rolled in unison over the hair to be trimmed, hair protrudes through the at least one aperture and is cut at a cutting point by a shearing force between relative movement of the first cutting blade and the second cutting blade;
- wherein at least part of the barrel has a comb that overhangs the second cutting blade so as to direct hair and space the cutting point from a user's skin.

13. The manually operable hair trimming device according to claim 12 further comprising a cover which has at least one opening formed therein through which a protruding part of the sleeve protrudes.

14. The manually operable hair trimming device according to claim 13 wherein edges of at least one aperture in the cover are tooth or scallop shaped.

* * * * *